US008707603B2

(12) United States Patent
Troy et al.

(10) Patent No.: US 8,707,603 B2
(45) Date of Patent: Apr. 29, 2014

(54) FIREARM BUTT STOCK GPS UNIT HOLDER

(76) Inventors: Stephen P. Troy, Lee, MA (US); Gary Morin, Hardwick, MA (US); Thomas Robert Doyle, Sanford, NC (US)

( * ) Notice: Subject to any disclaimer, the term of this patent is extended or adjusted under 35 U.S.C. 154(b) by 0 days.

(21) Appl. No.: 13/351,483

(22) Filed: Jan. 17, 2012

(65) Prior Publication Data

US 2013/0263489 A1 Oct. 10, 2013

Related U.S. Application Data

(60) Provisional application No. 61/433,324, filed on Jan. 17, 2011.

(51) Int. Cl.
*F41C 23/22* (2006.01)

(52) U.S. Cl.
USPC ..... 42/71.01

(58) Field of Classification Search
USPC ..... 42/71.01, 72–74
See application file for complete search history.

(56) References Cited

U.S. PATENT DOCUMENTS

| | | | | |
|---|---|---|---|---|
| 2,495,977 | A * | 1/1950 | Madsen | 42/71.01 |
| 7,002,553 | B2 * | 2/2006 | Shkolnikov | 345/169 |
| 7,937,873 | B2 * | 5/2011 | Keng | 42/71.01 |
| 8,327,569 | B2 * | 12/2012 | Kincel | 42/73 |
| 8,387,298 | B2 * | 3/2013 | Kincel | 42/74 |
| 2007/0261284 | A1 * | 11/2007 | Keng | 42/73 |
| 2010/0242333 | A1 * | 9/2010 | Kincel | 42/73 |
| 2010/0242334 | A1 * | 9/2010 | Kincel | 42/74 |
| 2011/0099872 | A1 * | 5/2011 | Bentley et al. | 42/71.01 |
| 2012/0174455 | A1 * | 7/2012 | Edelman et al. | 42/71.01 |
| 2012/0174456 | A1 * | 7/2012 | DePierro et al. | 42/71.01 |
| 2012/0186124 | A1 * | 7/2012 | Kincel | 42/74 |
| 2012/0204464 | A1 * | 8/2012 | Kincel | 42/73 |

* cited by examiner

*Primary Examiner* — Jonathan C Weber
(74) *Attorney, Agent, or Firm* — Parsons & Goltry; Robert A. Parsons; Michael W. Goltry

(57) ABSTRACT

A firearm butt stock includes a portable GPS unit having a display on a surface, and control buttons on adjacent surface/surfaces, and a butt stock including a cavity defined by sidewalls formed in one side thereof intermediate a rearward end and a forward end. The cavity receives the portable GPS unit therein with the display facing outwardly. Attachment apparatus removably secures the portable GPS unit within the cavity.

9 Claims, 2 Drawing Sheets

FIREARM BUTT STOCK GPS UNIT HOLDER

CROSS-REFERENCE TO RELATED APPLICATIONS

This application claims the benefit of U.S. Provisional Application No. 61/433,324 filed 17 Jan. 2011.

FIELD OF THE INVENTION

This invention relates to firearms.

More particularly, the present invention relates to accessories for use on firearms.

BACKGROUND OF THE INVENTION

It is often desirous to know one's specific location. This is particularly true of military personnel. GPS devices are well known and used in this capacity. Unfortunately, a GPS unit is typically another item which must be carried and can be misplaced or lost. Furthermore, when an individual's hands are occupied, something must be dropped in order to employ a GPS unit. In combat situations, releasing a weapon may put the combatant at a disadvantage.

It would be highly advantageous, therefore, to remedy the foregoing and other deficiencies inherent in the prior art.

An object of the present invention is to provide a butt stock which contains a GPS unit.

Another object of the present invention is to provide a GPS unit which can be used while maintaining a hold on a weapon.

SUMMARY OF THE INVENTION

Briefly, to achieve the desired objects and advantages of the instant invention provided is a firearm butt stock including a butt stock for a firearm, and a holder carried by the butt stock for removably receiving and retaining a portable GPS unit. In a specific aspect of the present invention, the holder further includes a cavity defined by sidewalls formed in one side of the butt stock intermediate a rearward end and a forward end. The cavity is sized for receiving a portable GPS unit therein with the display facing outwardly. Attachment apparatus is provided for removably securing the portable GPS unit within the cavity.

In another aspect, a firearm butt stock is provided which includes a portable GPS unit having a display on a surface, and control buttons on adjacent surface/surfaces, and a butt stock including a cavity defined by sidewalls formed in one side thereof intermediate a rearward end and a forward end. The cavity receives the portable GPS unit therein with the display facing outwardly. Attachment apparatus removably secures the portable GPS unit within the cavity.

In yet another aspect, the attachment apparatus includes a first fitting attached to the portable GPS unit and a second fitting attached to the portable GPS unit. The first fitting and the second fitting are received by the sidewalls of the butt stock, securely retaining the portable GPS unit therein.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
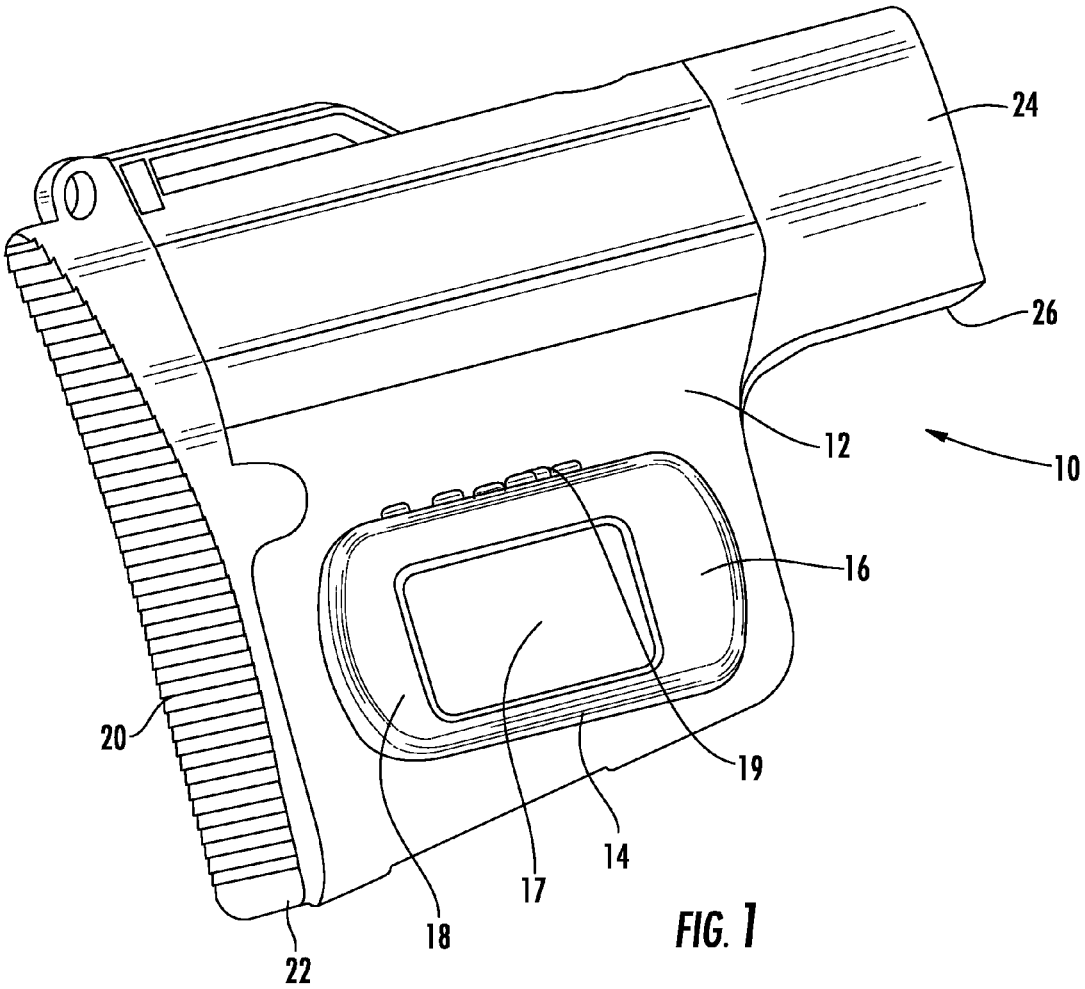
FIG. 1 is a perspective view of a firearm butt stock carrying a GPS unit.
Figure 2:
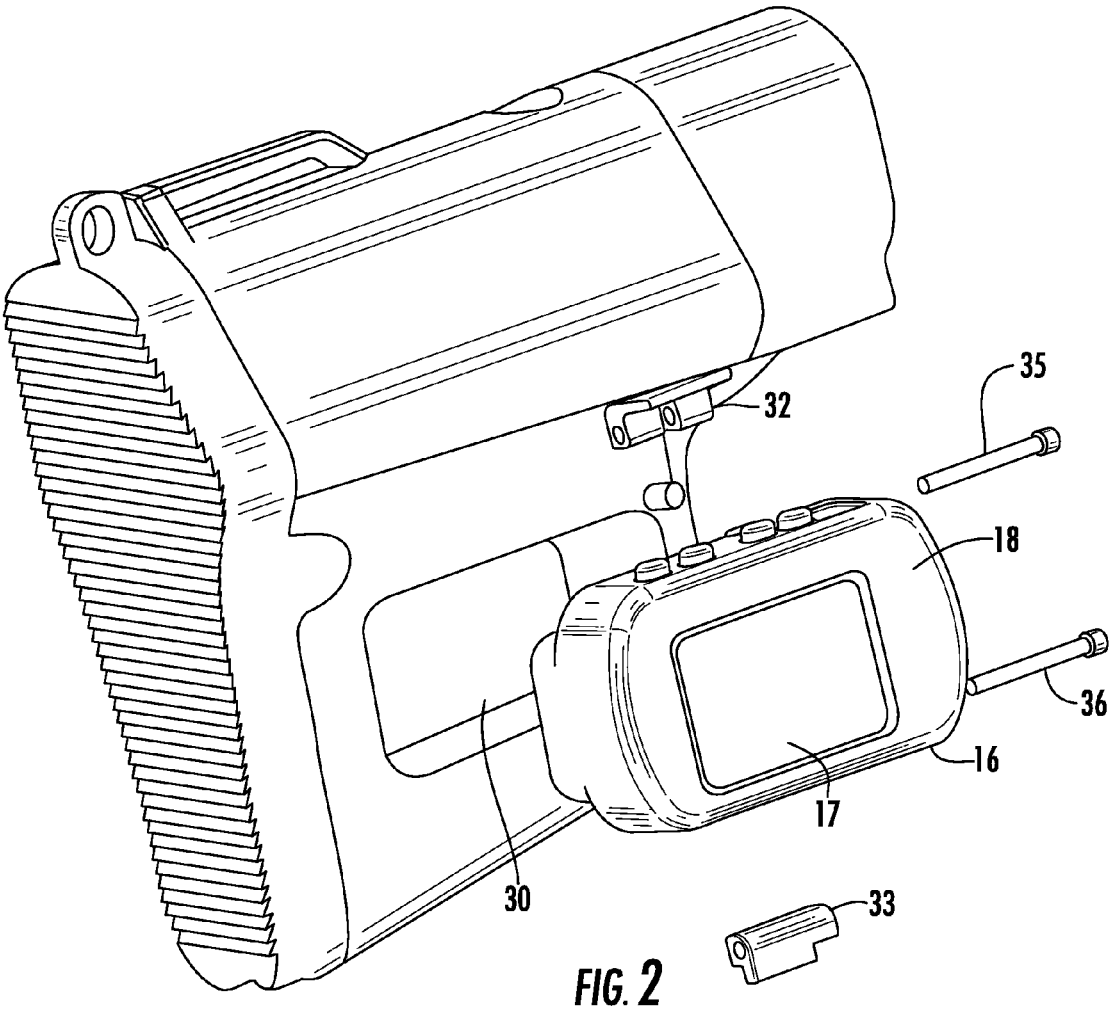
FIG. 2 is an exploded perspective view of FIG. 1.

Turning now to the drawings in which like reference characters indicate corresponding elements throughout the several views, attention is directed to FIGS. 1 and 2 which illustrate a firearm butt stock GPS unit holder generally designated 10. A firearm butt stock 12 includes a holder 14 for removably receiving and retaining a portable GPS unit 16. GPS unit 16 can be substantially any portable GPS unit available, and includes a display 17 on a surface 18 thereof, and control buttons 19 on surface/surfaces adjacent display 17. Butt stock 12 can be substantially any type of butt stock, but is preferably fabricated of formed plastics. Butt stock 12 includes a butt plate 20 at a rearward end 22 and an attachment portion 24 formed at a forward end 26. It will be understood that the forward end can be the entire rest of the stock of the firearm, or, as is preferred and illustrated, receives an extension member known in the art which attaches the butt stock to the rear of a firearm receiver.

Butt stock 12 further includes a cavity 30 defined by sidewalls formed in one side of butt stock 12 intermediate rearward end 22 and forward end 26. Cavity 30 is sized to receive GPS unit 16 therein, with display 17 facing outwardly and being visible to a user. Surface 18 is preferably slightly raised outwardly from the surface of the butt stock to provide access to control buttons 19 without the need to remove GPS unit 16.

Holder 14 includes cavity 30 for receiving GPS unit 16, and fittings 32 and 33 attached by pins 35 and 36, respectively, to GPS unit 16. Fittings 32 and 33 are received by portions of the sidewalls of butt stock 12 defining cavity 30, securely retaining GPS unit 16 therein. The portions of the sidewalls receiving the fittings are simply contours shaped to correspond to the shape of the fittings for receipt therein. One or more of fittings 32 and 33 can be spring loaded to bias it into contact with the walls of butt stock 12 defining cavity 30. By pressing the biased fitting against the bias, GPS unit 16 can be removed from cavity 30.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A firearm butt stock comprising:

a butt stock for a firearm;

butt stock to removably receive and retain a portable Global Positioning System (GPS) unit with a display; and the holder including a cavity defined by sidewalls formed in one side of the butt stock intermediate a rearward end and a forward end, the cavity sized for receiving the portable GPS unit therein with the display facing outwardly, and attachment apparatus for removably securing the portable GPS unit within the cavity.

2. A firearm butt stock as claimed in claim 1 wherein the attachment apparatus includes:

a first fitting attachable to the portable GPS unit;

a second fitting attachable to the portable GPS unit; and the first fitting and the second fitting are receivable by the sidewalls of the butt stock, for securely retaining the portable GPS unit therein.

3. A firearm butt stock as claimed in claim 2 wherein at least one of the first fitting and the second fitting is biased into contact with the side walls of the butt stock defining the cavity.

4. A firearm butt stock as claimed in claim 1 wherein the butt stock further includes a forward end coupled to a firearm receiver.

5. A firearm butt stock comprising:

a portable Global Positioning System (GPS) unit having a display on a surface, and control buttons on adjacent surface/surfaces;

a butt stock including a cavity defined by sidewalls formed in one side thereof intermediate a rearward end and a forward end, the cavity receiving the portable GPS unit therein with the display facing outwardly; and attachment apparatus removably securing the portable GPS unit within the cavity.

6. A firearm butt stock as claimed in claim 5 wherein the attachment apparatus includes:

a first fitting attached to the portable GPS unit;

a second fitting attached to the portable GPS unit; and the first fitting and the second fitting are received by the sidewalls of the butt stock, securely retaining the portable GPS unit therein.

7. A firearm butt stock as claimed in claim 6 wherein at least one of the first fitting and the second fitting is biased into contact with the side walls of the butt stock defining the cavity.

8. A firearm butt stock as claimed in claim 5 wherein the surface of the portable GPS unit is raised outwardly from a surface of the butt stock to provide access to control buttons without the need to remove the portable GPS unit.

9. A firearm butt stock as claimed in claim 5 wherein the butt stock further includes a forward end coupled to a firearm receiver.

* * * * *